US009080309B2

(12) United States Patent
Von Wirth

(10) Patent No.: US 9,080,309 B2
(45) Date of Patent: Jul. 14, 2015

(54) DEVICE FOR REMOVING SEA BED

(75) Inventor: Hermann Josef Von Wirth, Titz (DE)

(73) Assignee: MHWIRTH GMBH, Erkelenz (DE)

( * ) Notice: Subject to any disclaimer, the term of this patent is extended or adjusted under 35 U.S.C. 154(b) by 0 days.

(21) Appl. No.: 14/236,908

(22) PCT Filed: Jul. 19, 2012

(86) PCT No.: PCT/EP2012/064199

§ 371 (c)(1),
(2), (4) Date: Feb. 4, 2014

(87) PCT Pub. No.: WO2013/020788

PCT Pub. Date: Feb. 14, 2013

(65) Prior Publication Data

US 2014/0165430 A1 Jun. 19, 2014

(30) Foreign Application Priority Data

Aug. 5, 2011 (DE) ..... 10 2011 052 429

(51) Int. Cl.

| | |
|---|---|
| ***E02F 3/90*** | (2006.01) |
| ***E02F 7/10*** | (2006.01) |
| ***E02F 5/00*** | (2006.01) |
| ***E21C 50/00*** | (2006.01) |

(52) U.S. Cl.
CPC . *E02F 7/10* (2013.01); *E02F 3/902* (2013.01); *E02F 5/006* (2013.01); *E21C 50/00* (2013.01)

(58) Field of Classification Search
CPC ..... E02F 3/902; E02F 3/907; E02F 7/10; E02F 5/006
USPC ..... 37/307, 309, 335, 336; 137/107
See application file for complete search history.

(56) References Cited

U.S. PATENT DOCUMENTS

| | | | | | |
|---|---|---|---|---|---|
| 3,283,772 | A | * | 11/1966 | Ensign | 137/107 |
| 3,307,576 | A | | 3/1967 | Himes et al. | |
| 3,318,327 | A | * | 5/1967 | Himes et al. | 137/527.8 |
| 3,945,394 | A | * | 3/1976 | Sullivan et al. | 137/430 |
| 4,300,585 | A | * | 11/1981 | Taylor | 137/107 |
| 4,333,828 | A | * | 6/1982 | Taylor | 210/113 |
| 4,429,622 | A | | 2/1984 | Taylor | |
| 4,555,333 | A | * | 11/1985 | Laval, Jr. | 210/113 |
| 4,718,835 | A | * | 1/1988 | Maruyama | 417/171 |
| 5,491,913 | A | | 2/1996 | Hutchinson | |
| 7,185,953 | B1 | * | 3/2007 | Young | 298/24 |
| 8,165,722 | B2 | * | 4/2012 | Yoon et al. | 700/282 |

FOREIGN PATENT DOCUMENTS

| | | | |
|---|---|---|---|
| DE | 2 008 384 | A1 | 9/1971 |
| JP | 56-134995 | U | 10/1981 |
| JP | 60-10093 | A | 1/1985 |
| JP | 6-54074 | B2 | 7/1994 |

* cited by examiner

*Primary Examiner* — Jamie L McGowan
(74) *Attorney, Agent, or Firm* — Norman B. Thot

(57) ABSTRACT

A device for removing sea bed includes a conveying line at least partially surrounded by sea water and an emergency emptying device arranged in the conveying line. The conveying line is configured to have a sea bed be removed therethrough so that a removed sea bed is transportable to a surface in a conveying direction. The emergency emptying device is configured so that the removed sea bed moving in a direction counter to the conveying direction in the conveying line is dischargeable from the conveying line into the sea water.

10 Claims, 2 Drawing Sheets

DEVICE FOR REMOVING SEA BED

CROSS REFERENCE TO PRIOR APPLICATIONS

This application is a U.S. National Phase application under 35 U.S.C. §371 of International Application No. PCT/EP2012/064199, filed on Jul. 19, 2012 and which claims benefit to German Patent Application No. 10 2011 052 429.0, filed on Aug. 5, 2011. The International Application was published in German on Feb. 14, 2013 as WO 2013/020788 Al under PCT Article 21(2).

FIELD

The present invention relates to a device for removing sea bed having a conveying line operated according to the airlift method, or using feed pumps, which is at least partially surrounded by sea water, and by which removed sea bed can be transported in the conveying direction to the surface.

BACKGROUND

The "airlift method" is understood as the method for transporting removed sea bed. The airlift method provides a supply of compressed air into the bottom area of the conveying line. The air bubbles that rise on the inside of the conveying line create the effect of an upward flow on the inside of the drilling line that transports removed sea bed to a marine unit above the water line.

When such a conveying apparatus is employed for transporting mineral raw materials, such as, for example, manganese nodules from a water depth of approximately 5,000 m, the volume portion of the material transported inside the conveying line can constitute up to 10% of the internal volume of the conveying line. The conveying line can, for example, have an inside diameter of 40 cm.

It is regularly possible to generate a stronger upward flow if feed pumps are used. The volume fraction of the conveyed material is then greater, however, the method tends to be even more susceptible to clogging.

If the conveying operation of removed sea bed comes to a standstill (irrespective of the reason therefor), the sea bed material that is inside the conveying line sinks very quickly to the bottom because it has a considerably higher density than sea water. Assuming a water depth of 5,000 m and a volume fraction of removed sea bed of 10%, the result is a 500 m long plug clogging the line. Freeing the conveying line of the plug by regular means is then either impossible, or only possible with great difficulty. Similarly, it is no longer possible to salvage the conveying line due to the large mass of the plug, which can be as much as 1,500 to 2,000 $\tau$ in the given example. In a worst case scenario, this means that the conveying line may need to be abandoned following such an interruption of the conveying operation.

A reason for such an interruption can be, for example, a failure of a transport of flow inside of the conveying line. Such a failure can be caused by deposits of removed sea bed on the interior lining of the conveying line which gradually increase until they create a blockage of the complete internal cross-section or of the conveying line. Another conceivable reason for a blockage is an energy supply failure or a compressor failure which results in the compressed air necessary for the operation of the airlift process no longer blowing into the conveying line. If the sea bed is first pumped via solid-material pumps from a clearing vehicle to an interim station, which is also referred to as a "buffer," and transported from there via the conveying line to the marine unit above the water line, defects on the submarine unit can also result in a failure of flow transport. Extreme environmental events having a propensity of causing an interruption in flow transport are moreover conceivable.

DE 2008384 A describes a dual pipe conveying facility that has an annular pipe line with pipes that are routed as a sink pipe from the ocean surface down to the ocean floor and as a lift pipe for the transported material back up to the ocean surface. Pressurized water preferably circulates inside this annular pipe line as a transport fluid, wherein the pressurized water is circulated by pumps. The conveyed material is fed into the annular pipe line via a pressure lock on the ocean floor. The pressure of the pressurized fluid is dimensioned such that the conveyed material fed into the annular line is raised inside the lift pipe all the way to the water surface.

SUMMARY

An aspect of the present invention is to improve a device, as was described in the introduction above, where the clogging risk by the formation of a plug, accompanied by an interruption of operations or a failure of the transport of flow, is substantially reduced.

In an embodiment, the present invention provides a device for removing sea bed which includes a conveying line at least partially surrounded by sea water and an emergency emptying device arranged in the conveying line. The conveying line is configured to have a sea bed be removed therethrough so that a removed sea bed is transportable to a surface in a conveying direction. The emergency emptying device is configured so that the removed sea bed moving in a direction counter to the conveying direction in the conveying line is dischargeable from the conveying line into the sea water.

BRIEF DESCRIPTION OF THE DRAWINGS

The present invention is described in greater detail below on the basis of embodiments and of the drawings in which.

DETAILED DESCRIPTION

Figure 1:
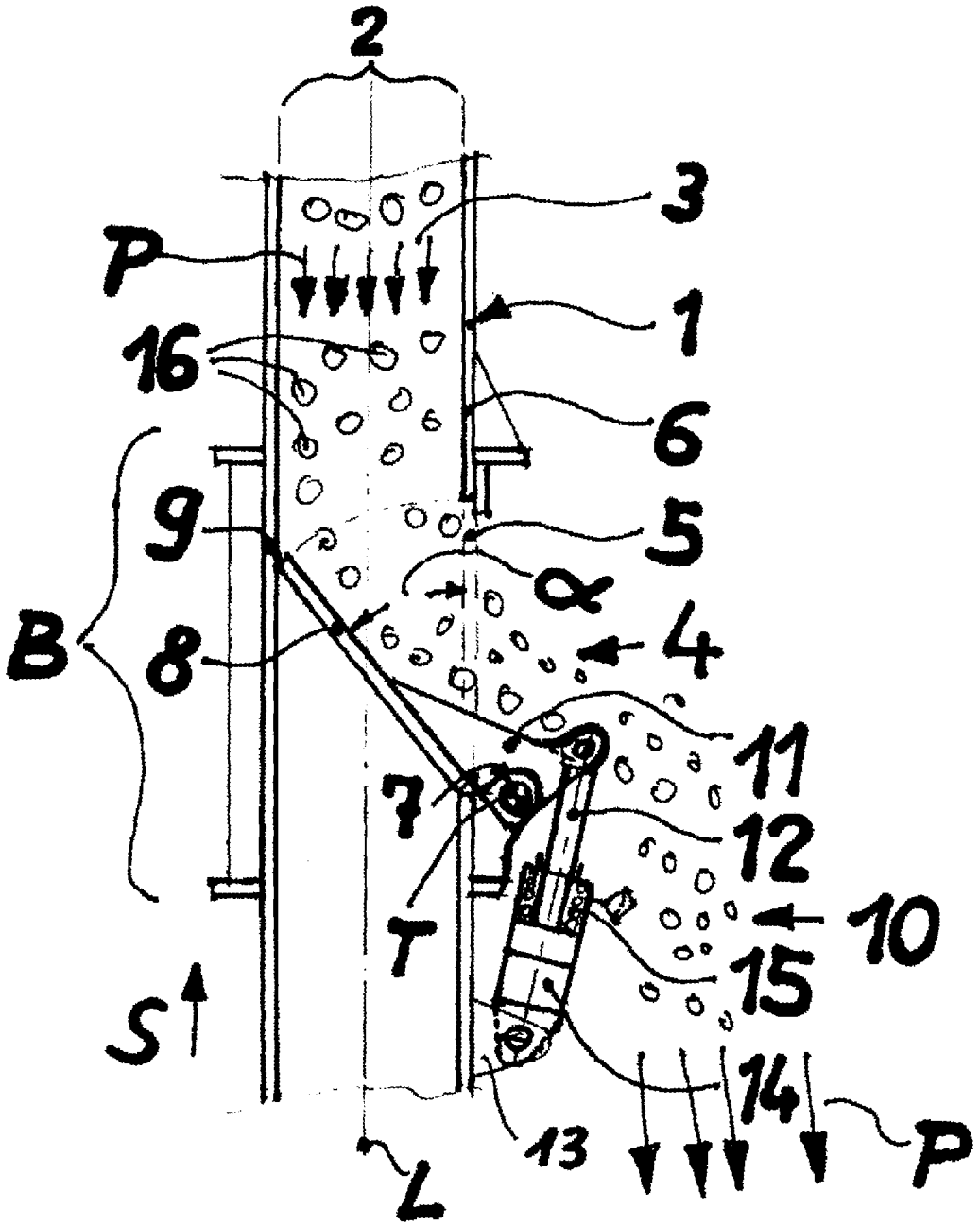
FIG. 1 shows a schematic representation of a view of a region of the conveying line around an emergency emptying opening, as seen in a partial longitudinal section.

The conveying line of the device according to the present invention comprise an emergency emptying means by which removed sea bed, which is transported counter to the conveying direction, can be discharged from the conveying line and into the sea water. This measure prevents the removed sea bed, which is present inside the conveying line at the time of the interruption or the failure of the transport flow, from forming a plug of the kind described above that becomes deposited in the line and clogs the bottom end of the conveying line.

In embodiment of the device according to the present invention, the emergency emptying means can, for example, comprise at least one emergency emptying means that can be opened and closed, and through which removed sea bed material moving against the direction of transport can be discharged into the surrounding sea water.

To further accelerate such a discharge in order to further reduce down-times and any residual clogging risk, a plurality of emergency emptying openings can, for example, be provided and, for example, disposed approximately at regular intervals over the length of the conveying line.

In an embodiment of the present invention, the openings can, for example, be spaced every 200 m to 700 m, for example, at 400 m and 500 m intervals. Assuming that the removed sea bed inside the conveying line typically sinks at 0.5 m/s following such a disruption of flow, the emergency emptying openings would have to remain open, for example, for 13 to 17 minutes to provide an almost complete evacuation of removed sea bed from the inside of the conveying line.

In an embodiment of the device according to the present invention, an emergency emptying door can, for example, be provided on each emergency emptying opening. The emergency emptying door can be displaced into the interior of the conveying line so that any removed sea bed moving counter to the conveying direction can be discharged by the action of the emergency emptying door through the emergency emptying opening and into the sea water.

A piston/cylinder apparatus that can be operated by water-hydraulic means can, for example, be provided for actuating the displacement of the emergency emptying door between the open and the closed positions. An advantage of a water-hydraulic actuation is that it is environmentally safe. If leaks occur, no hydraulic oil can escape which could damage the environment. It is moreover possible to omit a closed system for circulating hydraulic fluid altogether, because, when pressure is to be relieved, the water is simply discharged into the environment and any return by way of a separate return line into the pressure reservoir can be omitted. The water-hydraulically operated apparatus can therefore be conceived as having only a single, central hydraulic supply for the totality of all piston/cylinder devices.

To avoid having to apply a continuous pressure to the water-hydraulically actuated piston/cylinder devices during the conveying operation, the piston/cylinder devices are spring loaded so that the emergency emptying doors move to their closed positions when no water-hydraulic pressure is in effect. This means that only one pressure application to the piston/cylinder devices is necessary when the transport of flow inside the conveying line comes to a halt due to a malfunction.

In an embodiment of the present invention, the hydraulic line can, for example, be connected to a water reservoir that supplies the water-hydraulic pressure. The hydraulic line can also include a closed water tank that is filled with compressed air above the water level. It is possible to connect the tank to a compressor that maintains the internal pressure inside the tank at a preset value.

In an embodiment of the present invention, the hydraulic line connected to a water reservoir can, for example, includes a free end that is closed by a check valve. The check valve is disposed so that it opens against the pressure that is present inside the hydraulic line. Using this hydraulic line, the piston/cylinder devices are connected for the purpose of actuating them against the spring force.

In an embodiment of the present invention, a switching valve can, for example, be disposed between the water reservoir and the hydraulic line that is able to execute the following switching positions:

Separation of the water reservoir from the hydraulic line by means of a check valve that opens against the water-hydraulic pressure provided by the water reservoir. This is the switching position of the switching valve during a normal operation of the device; i.e., when the desired conveyed flow is present inside the conveying line.

Connection of the water reservoir to the hydraulic line. This switching position can be manually actuated and, provided the corresponding sensors are present, can automatically be actuated in the event of a failure. In this switching position, the pressure applied by the water reservoir to the water in the hydraulic line actuates the piston/cylinder devices against the spring pressure so that the emergency emptying doors are displaced to the inside of the conveying line for the purpose of discharging removed sea bed to the outside.

Separation of the water reservoir from the hydraulic line and simultaneous closing of the water reservoir as well as opening of the hydraulic line to the environment. The switching valve is brought in this position when the conveying operation must be restarted after a disruption in the conveying operation has been remedied, and/or after the material that is inside the conveying line was discharged into the surrounding sea water by opening the emergency emptying openings.

The present invention will be described in further detail below based on the drawings.

The embodiment of a device according to the present invention, as depicted in the drawing, comprises a conveying line 1, a section of which is shown in FIG. 1. The conveying line 1 is approximately pipe-like with an inside diameter 2 of 2 to 40 cm. The conveying line 1 serves to transport removed sea bed to the surface using the so-called "airlift method." Mineral raw materials are in particular conceivable as removable sea bed, such as, for example, manganese nodules that are mined at an underwater depth of approximately 5,000 m. The length of the conveying line 1 is therefore approximately 5,000 m.

Using the airlift method, an upward fluid flow is created on the interior 3 of the conveying line 1, as symbolically indicated by the arrow S.

To avoid large quantities of removed sea bed becoming impacted at the lower end of the conveying line 1 and forming a plug if the operation is interrupted due to a failure in the transport of flow, emergency emptying means 4 are provided, respectively spaced at 500 m intervals.

The functionality of these emergency emptying means 4 shall be described in further detail below in reference to FIG. 1, which depicts said emergency emptying means 4 in the activated state.

In section B, which is where the emergency emptying opening 5 is located, the conveying line 1 has an approximately oval cross-section. Below the emergency emptying opening 5, a bearing means 7 is provided on the outside of the wall 6 of the conveying line 1, where an emergency emptying door 8 of the emergency emptying means 4 is connected in an articulated manner and can be pivoted about a hinge axis T that is arranged transversely relative to the longitudinal extension L of the conveying line 1. The emergency emptying door 8 can be pivoted from a closed position, in which the emergency emptying opening 5 is completely closed and the emergency emptying door 8 is substantially flush with the wall 6 of the conveying line 1, to an open position, as depicted in FIG. 1, in which the emergency emptying door 8 rests by the remote edge 9 thereof relative to the hinge axis T internally against the wall 6 on the side that is opposite the emergency emptying opening 5, therein forming an opening angle a of approximately 30° with an opening plane.

A water-hydraulically powered piston/cylinder apparatus 10 is provided for the pivot actuation between the closed and the opened positions. The piston/cylinder apparatus 10 engages via a piston rod 12 via a lever 11, which protrudes approximately perpendicularly from the surface of the emergency emptying door 8. A cylinder-side end of the piston/ cylinder apparatus 10 is fastened to a bearing projection 13, again on the exterior of the wall 6.

A compression spring 15 is disposed in the annular space between the piston rod 12 and a cylinder space 14. The compression spring 15 causes the piston rod 12 to be supported in a retracted position when the emergency emptying door 8 is flush with the wall 6 so as to seal the emergency emptying opening 5 when no pressurized water is applied to the cylinder space.

In the position of the emergency emptying door 8 as depicted in FIG. 1, removed sea bed is guided in the form of solid material particles 16, which are symbolized by the circles as presently shown in FIG. 1, while sinking as a result of a malfunction or interruption of the transport of flow within the meaning of the arrows P, and discharged toward the outside into the surrounding environment of the conveying line 1. Due to the fact that a typical sink rate of the removed sea bed (as previously described) is approximately 0.5 m/sec, an accumulation of the sunken sea bed material in the ambient area surrounding the bottom end of the conveying line 1 can be precluded because even small ocean currents that are in effect outside of the conveying line 1 will cause the material to be distributed over a large terrain.

The apparatus that is provided for the water-hydraulic actuation of the piston/cylinder apparatus 10 and the emergency emptying door 8 shall be described in further detail below in reference to FIG. 2.

Figure 2:
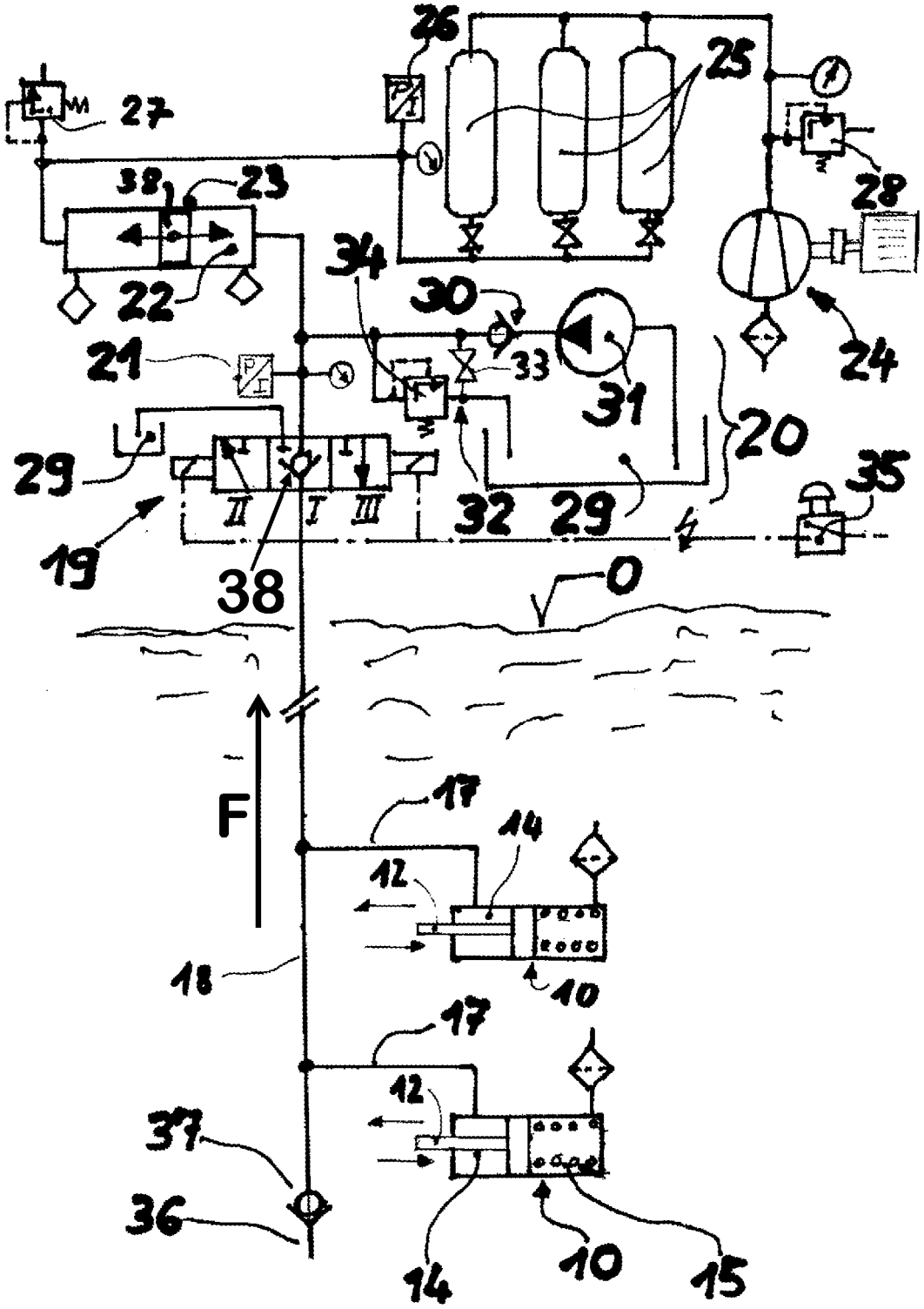
FIG. 2 shows a representation of the hydraulic diagram of an embodiment of the device according to the present invention.

In FIG. 2, O designates the sea water surface. For actuation purposes, the cylinder chambers 14 of the piston/cylinder devices 10 are connected to a hydraulic line 18 via the supply lines 17. As can be seen in the schematic sectional representation in FIG. 2 of the piston/cylinder devices 10, the compression spring 15 operates in an embodiment according to FIG. 2 with an effect on the floor of the piston on a side that is opposite of the piston rod 12. The cylinder volumes are correspondingly formed by the annular space that surrounds the piston rod 12. This configuration, that is reversed in relation to the embodiment according to FIG. 1, has the advantage of a lesser cylinder volume filled with hydraulic fluid, such that, due to the return displacement of the pistons that is effected by the compression springs 15 as well as for the displacement of the pistons due to the water-pneumatic pressure, only smaller amounts of water must be transported, whereby it is possible to reduce the actuation times.

The hydraulic line 18 is hydraulically connected to a water reservoir 20 by way of a switching valve 19. A measurement means 21 is disposed between the switching valve 19 and the water reservoir 20 which measures the amount of the flow-through and the pressure that the water is subject to within the hydraulic line 18.

The water reservoir 20 comprises a pressure tank 22. The pressure tank 22 is filled with water to a filling level 23. A freely movable piston 38 is disposed above the filling level 23, and a compressed air cushion is in effect acting upon the same, whereby the air cushion is generated with the aid of a high-pressure piston compressor 24 that is connected via a high-pressure air accumulator 25 to the pressure tank 22, which is also referred to as the "piston accumulator." A pressure measurement instrument 26 and a pressure relief valve 27 are activated in the supply line to the pressure tank 22. The pressure line that runs between the high-pressure piston compressor and the high-pressure air accumulators is also provided with corresponding means 28.

The water reservoir 20 further comprises a fresh water tank 29 from which, via a line, which is protected with the aid of a check valve 30 against reflux, a high-pressure water pump 31 pumps pressurized water into the pressure tank 22 to achieve and/or maintain the desired filling level 23. A bypass 32 is switched between the high-pressure water pump 31 and the hydraulic line 18 that leads to the fresh water tank 29, which is connected to the line via a stop cock 33 and a pressure relief valve 34.

If a malfunction or interruption of the transport of flow is detected in the conveying line 1, triggering an emergency switch 35 that engages the switching valve 19, which is actuated manually or via suitable sensors (which are not shown in the present drawings), and which measures the transported flow inside the conveying line 1, results in the switching valve 19 being moved into the switching position III. In this switching position, the hydraulic line 18 is connected to the pressure tank 22. Due to the pressure increase, water flows into the cylinder chambers 14 of the piston/cylinder apparatuses 10 which are thereby actuated against the effect of the compression springs 15, thus causing the emergency emptying doors 8 to open. Sinking solid material particles 16 are deflected laterally through the emergency emptying openings 5 to the outside, as described above.

To close the emergency emptying openings 5, employing suitable means, the switching valve 19 is moved into switching position II. In this position, the supply line from the pressure tank 22 is closed by the hydraulic line 18. The hydraulic line 18 is open toward the environment and/or a fresh water reservoir, which can be a fresh water tank 29. Due to the retractive forces generated by the compression springs 15, the emergency emptying doors 8 are moved to the closed position with the aid of the piston rods 12. After reaching said position, the switching valve 19 is moved into the resting position I as depicted in FIG. 2, when the hydraulic line 18 is connected by a check valve 38 that opens against the water-hydraulic pressure as provided by the water reservoir 20 with a fresh water reservoir 29.

The hydraulic line 18 includes an end 36 that is free relative to the environment. It is closed via a check valve 37 that must be opened against the pressure that is present inside the hydraulic line 18.

The present invention is not limited to embodiments described herein; reference should be had to the appended claims.

LIST OF REFERENCE NUMBERS

1 Conveying line
2 Inside diameter
3 Interior
4 Emergency emptying means
5 Emergency emptying opening
6 Wall
7 Bearing means
8 Emergency emptying door
9 Edge
10 Piston/cylinder apparatus
11 Lever
12 Piston rod
13 Bearing projection
14 Cylinder chamber
15 Compression spring
16 Solid particle materials
17 Supply lines
18 Hydraulic line
19 Switching valve
20 Water reservoir
21 Measurement means
22 Pressure tank
23 Filling level

24 High-pressure piston compressor
25 High-pressure air accumulator
26 Pressure measurement instrument
27 Pressure relief valve
28 Means
29 Fresh water tank
30 Check valve
31 High-pressure water pump
32 Bypass
33 Stop cock
34 Pressure relief valve
35 Emergency switch
36 End
37 Check valve
38 Check valve
α Opening angle
B Section
F Direction of transport
L Longitudinal extension
O Sea water surface
P Arrows
S Arrow
T Hinge axis

What is claimed is:

1. A device for removing sea bed, the device comprising:

a conveying line at least partially surrounded by sea water, the conveying line being configured to have a sea bed be removed therethrough so that a removed sea bed is transportable to a surface in a conveying direction;

an emergency emptying device arranged in the conveying line, the emergency emptying device being configured so that the removed sea bed moving in a direction counter to the conveying direction in the conveying line is dischargeable from the conveying line into the sea water;

a piston/cylinder apparatus configured to be actuated by a water-hydraulic pressure and to move an emergency emptying door;

a water reservoir configured to provide the water-hydraulic pressure; and a switching valve arranged between the water reservoir and a hydraulic line, the switching valve being configured to activate a switching state selected from:

a separation of the water reservoir from the hydraulic line via a check valve configured to open against the water-hydraulic pressure provided by the water reservoir, a connection of the water reservoir with the hydraulic line, and a separation of the water reservoir from the hydraulic line, a closing of the water reservoir, and an opening of the hydraulic line to a surrounding environment.

2. The device as recited in claim 1, wherein the emergency emptying device comprises at least one emergency emptying opening configured to be opened or closed and to laterally discharge the removed sea bed moving in the direction counter to the conveying direction from the conveying line into the sea water.

3. The device as recited in claim 2, wherein the emergency emptying device comprises at least two emergency emptying openings.

4. The device as recited in claim 3, wherein the at least two emergency emptying openings are arranged at regular intervals over a length of the conveying line.

5. The device as recited in claim 3, wherein the at least two emergency emptying openings are arranged so as to be spaced every 200 m to 700 m.

6. The device as recited in claim 3, wherein the at least two emergency emptying openings are arranged so as to be spaced every 400 m to 500 m.

7. The device as recited in claim 2, further comprising an emergency emptying door arranged at each emergency emptying opening, the emergency emptying door being configured to move so as to open the emergency emptying opening towards an interior of the conveying line so that the removed sea bed moving in the direction counter to the conveying direction is dischargeable via the emergency emptying door though the emergency emptying opening into the sea water.

8. The device as recited in claim 1, wherein the piston/cylinder apparatus comprises a compression spring configured to move the emergency emptying door into a closed position when no water-hydraulic pressure is applied.

9. The device as recited in claim 1, wherein the water reservoir comprises the hydraulic line which is configured to connect the piston/cylinder apparatus so as to actuate the piston/cylinder apparatus against a force of a compression spring.

10. The device as recited in claim 9, wherein the hydraulic line comprises a free end and a check valve, the check valve being configured to seal the free end.

* * * * *